US005642950A

United States Patent [19]

Hochgesang et al.

[11] Patent Number: 5,642,950

[45] Date of Patent: Jul. 1, 1997

[54] KEYBOARD WITH A PROTECTIVE FOIL

[75] Inventors: Gerhard Hochgesang; Werner Lorz, both of Bad Neustadt, Germany

[73] Assignee: Preh-Werke GmbH & Co. KG, Bad Neustadt, Germany

[21] Appl. No.: 592,671

[22] Filed: Jan. 26, 1996

[30] Foreign Application Priority Data

Feb. 21, 1995 [DE] Germany ..... 195 05 852.6

[51] Int. Cl.[6] ..... B41J 5/12

[52] U.S. Cl. ..... 400/490; 400/472; 200/302.2

[58] Field of Search ..... 400/472, 490; 341/21, 22, 33; 361/680; 200/302.2, 514, 517; 345/168

[56] References Cited

U.S. PATENT DOCUMENTS

| | | | |
|---|---|---|---|
| 4,471,189 | 9/1984 | Bacon et al. | 200/159 B |
| 4,555,600 | 11/1985 | Morse | 179/184 |
| 4,755,072 | 7/1988 | Hoornweg | 400/490 |
| 5,183,346 | 2/1993 | Tesar | 400/490 |
| 5,300,742 | 4/1994 | Huang | 200/302.002 |
| 5,348,405 | 9/1994 | Lupkas | 400/472 |

FOREIGN PATENT DOCUMENTS 9310721 12/1993 Germany .

*Primary Examiner*—Edgar S. Burr
*Assistant Examiner*—Dave A. Ghatt
*Attorney, Agent, or Firm*—Griffin, Butler Whisenhunt & Kurtossy

[57] ABSTRACT

A keyboard has a protective foil which is a formed part to have dome-shaped vaults extending upwardly from a foil floor at respective individual keys of the keyboard. The protective foil is inverted (dome interiors open downwardly) so that the keys are respectively arranged relative to the vaults (8) and replaceable caps (9) are snapped onto the vaults and keys.

8 Claims, 2 Drawing Sheets

KEYBOARD WITH A PROTECTIVE FOIL

BACKGROUND OF THE INVENTION

This invention concerns a keyboard of a type having a protective foil suspended, or supported, in a frame for covering keys.

Such keyboards with protective foils are used for cash registers and other registers, for example in retail trade where the protective foils are needed to protect the keyboards from dirt contamination and moisture.

Such a protective foil, which is suspended, or supported, across an entire keyboard, is disclosed, for example, in German Gebrauchsmuster 93 10 721.8. This arrangement is suitable for keyboards whose keys have short switching strokes.

It is known to use protective foils which have openings for each of the keys, with the openings being filled by sealing configurations of the keys. Although these embodiments can also be used for keyboards having large switching strokes, they are difficult to clean and there is always the danger that a seal will be lost.

It is an object of this invention to provide a foil covering of the type described above which can be used for keyboards having large key switching strokes and which can be easily, and without danger, cleaned, while also giving the keyboards pleasing appearances.

SUMMARY

According to principles of this invention a protective foil is supported above keys of a keyboard, with the protective foil being a formed part to have dome-shaped vaults extending upwardly, at each key, from a foil floor. Each key then extends upwardly into its respective vault and a cap is mounted on each respective key above the foil of the respective vault so that the foil is between the caps and the keys.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
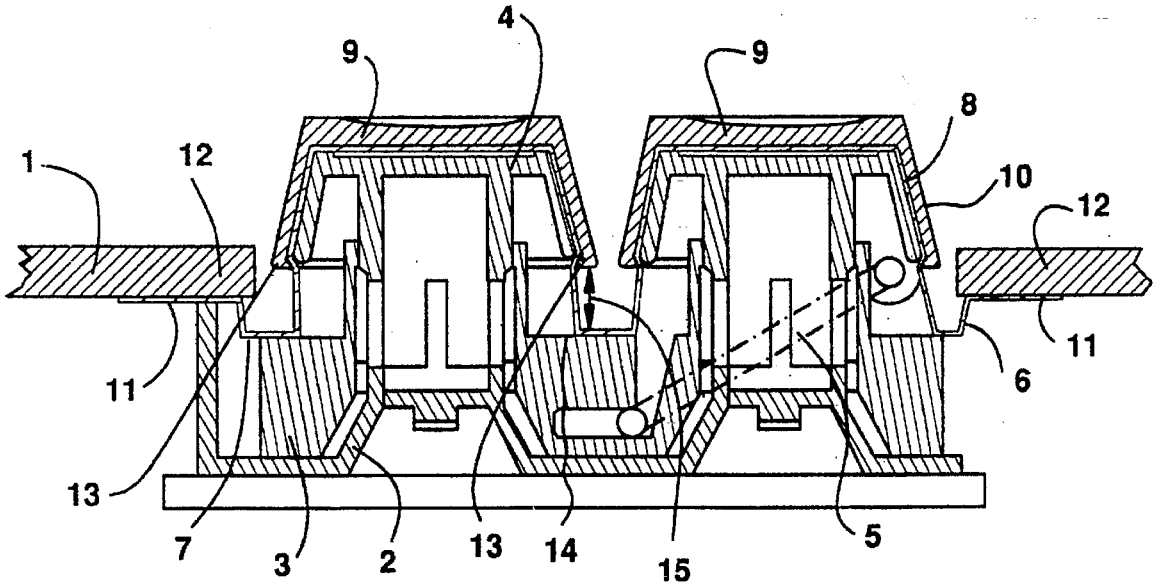
FIG. 1 is a segmented cross-sectional view of two keys of a keyboard having a protective foil of this invention thereon.
Figure 1A:
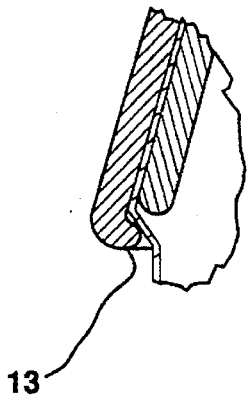
FIG. 1A is a segmented cross sectional enlarged view of a lower edge of one key of the keyboard depicted in FIG. 1.

FIG. 1 shows a keyboard for use in cash registers and other registers which comprises a housing 1, a contact mat 2, a key guidance frame 3, keys 4 which are held clipped (or snapped) in the key guidance frame 3 so that they cannot be lost, and also possibly a holding clip 5 for parallel guidance of the keys 4.

The keys 4 are covered by a protective foil 6, with the protective foil 6 being made as a formed part to have dome-shaped vaults 8 extending upwardly from a foil floor 7, the foil vaults being inverted over the keyboard.

The vaults are arranged so that each key extends into a vault. Replaceable caps 9 are snapped over the vaults 8 and the keys 4 whereby the keys 4, the protective-foil vaults 8 and the replaceable caps 9 have truncated pyramidal cross sections 10 with corresponding measurements and slopes, or rises, so that they are wedged together in interengagement.

Alternatively, or additionally, the replaceable cap 9 can be clipped, or snapped, to the key 4 and/or protective foil 6.

The protective foil 6 has a surrounding collar 11, which when mounted, as is shown on the left side of FIG. 1, is wedged between a housing flange 12 and the contact mat 2, or, as is shown on the right side, is attached, or adhered, to the housing flange 12.

Figure 2:
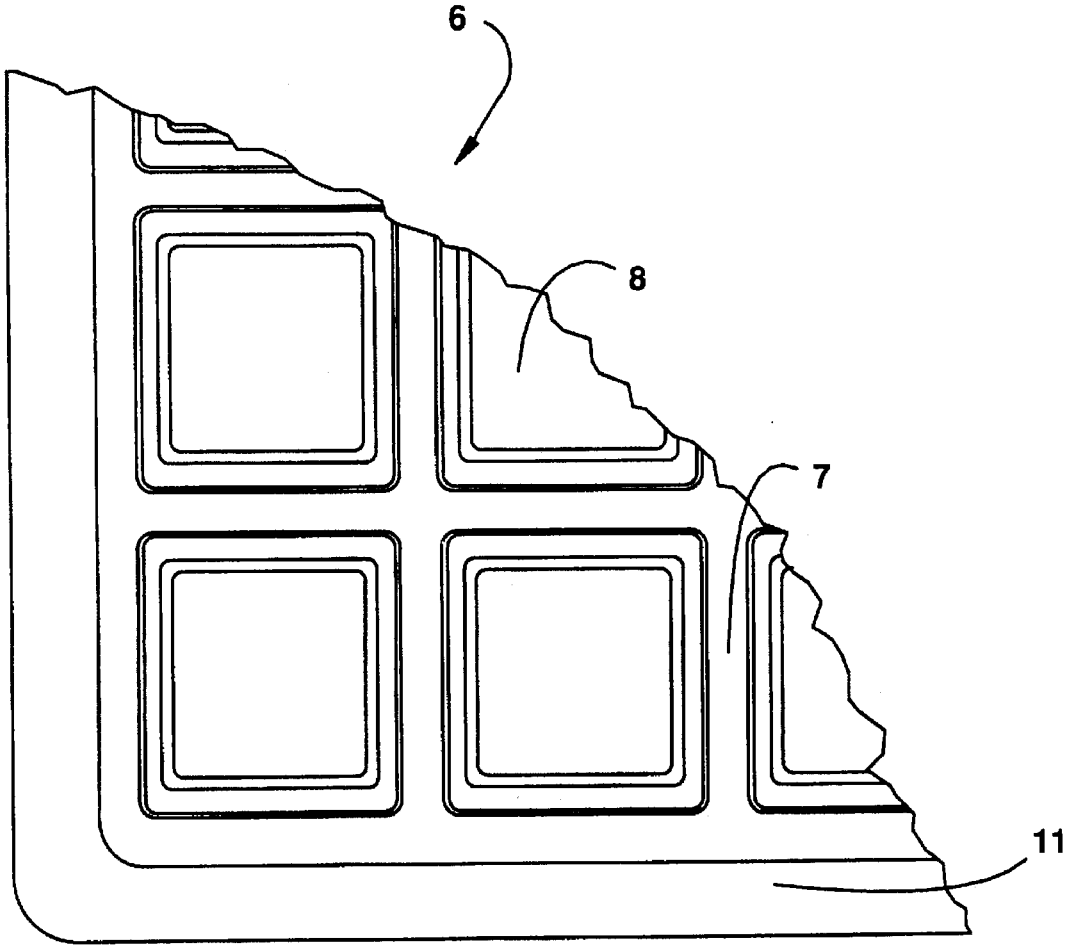
FIG. 2 is a segmented top plan view of the protective foil of FIG. 1.
Figure 3:
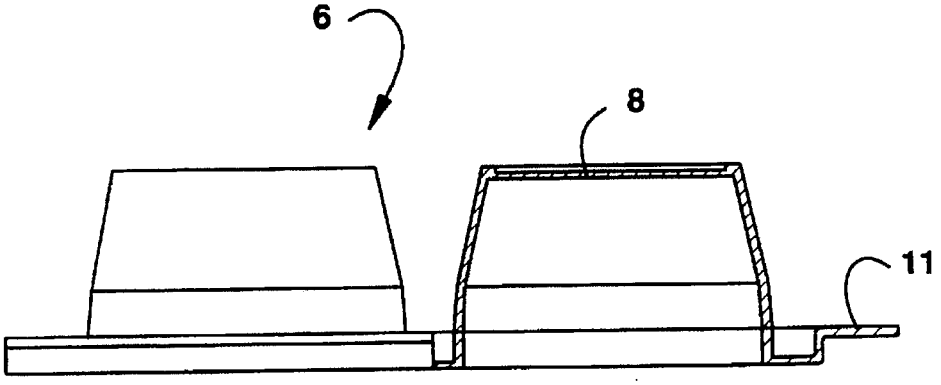
FIG. 3 is a side view of the protective foil of FIG. 1 with one dome-shaped vault being cut away to be shown in cross section.

FIGS. 2 and 3 show the protective foil 6 as a separate part along with the vaults 8 which rise from the floor 7 as well as the collar 11.

In order to provide a stress free deformation of the protective foil 6, it is provided that a lower edge 13 of the replaceable cap 9 has a spacing 15 from the floor 7 of the protective foil which is larger than a switching stroke of the key 4, and additionally that the floor 7 lies on a supporting surface 14 of the key guidance frame 3.

The protective foil can be made from an elastomer, for example, sold under the trademark Elestollan SP 806-50 of the company Elastogran Polyurethane GmbH of Lemf örde, Germany and has preferably a thickness of between 50–100 μm.

The inventive keyboard of this invention is easy to clean, has a key guidance system which is sealed, has a very pleasing appearance because of the shoved-on replaceable caps 9, and additionally can be made to match new prices and articles by means of the replaceable caps 9.

The keyboard of this invention is usually used for sales registers and other registers used by cashiers. This invention overcomes substantial contamination. The protective foil will not normally be used for large switch strokes.

While the invention has been particularly shown and described with reference to a preferred embodiment, it will be understood by those of ordinary skill in the art that various changes in form and detail may be made therein without departing from the spirit and scope of the invention.

The invention claimed is:

1. A keyboard having individual keys with a protective foil for use in cash registers and the like, of a type in which the protective foil is supported above the keys of the keyboard by a housing; wherein:

the protective foil has a substantially uniform thickness of between 50 μm and 100 μm and is a formed part to have dome-shaped vaults extending upwardly from a foil floor at respective individual keys;

each key is arranged to extend inside a cavity formed by a respective vault;

wherein is further included replaceable caps for respective keys which are mounted on the respective keys above the foil of the respective vaults so that the dome-shaped vaults are between the caps and the keys.

2. A keyboard as in claim 1 wherein the keys, protective-foil vaults and the replaceable caps have a truncated pyramidal cross sections with corresponding measurements and tapers so that they wedge together.

3. A keyboard as in claim 1 wherein the replaceable caps are clipped to the protective foil.

4. A keyboard as in claim 1 wherein the protective foil has a surrounding collar which during fabrication is clamped between a housing flange and a contact mat.

5. A keyboard as in claim 1 wherein the protective foil has a surrounding collar which is attached to a housing flange.

6. A keyboard as in claim 1 wherein lower edges of the replaceable caps are spaced from the foil floor by a spacing that is greater than switching strokes of the keys.

7. A keyboard as in claim 1 wherein the foil floor of the protective foil is supported on a surface of a key guidance frame.

8. A keyboard as in claim 1 wherein the replaceable caps are clipped to the respective keys.

* * * * *